US005441024A

United States Patent [19]

Wietig et al.

[11] Patent Number: 5,441,024

[45] Date of Patent: Aug. 15, 1995

[54] ENGINE VALVE

[75] Inventors: Frederick G. Wietig, East Aurora; Timothy M. Deakin, Clarence, both of N.Y.

[73] Assignee: Val-Kro, Inc., N. Tonawanda, N.Y.

[21] Appl. No.: 239,576

[22] Filed: May 9, 1994

[51] Int. Cl.[6] ..... F01L 3/04

[52] U.S. Cl. ..... 123/188.3; 123/188.11; 29/888.46

[58] Field of Search ..... 123/188.1, 188.2, 188.3, 123/188.9, 188.11; 29/888.40, 888.46

[56] References Cited

U.S. PATENT DOCUMENTS

| | | | |
|---|---|---|---|
| 3,911,875 | 10/1975 | Ysberg | 123/188.3 |
| 4,465,040 | 8/1984 | Pelizzoni | 123/188.9 |
| 4,746,375 | 5/1988 | Iacovangelo | 148/20.3 |
| 4,811,701 | 3/1989 | Bühl et al. | 123/188.3 |
| 4,905,658 | 3/1990 | Pfefferle | 123/188.3 |
| 5,190,002 | 3/1993 | Wietig | 123/188.3 |
| 5,370,364 | 12/1994 | Kenmoku | 123/188.3 |

FOREIGN PATENT DOCUMENTS

| | | | |
|---|---|---|---|
| 4148003 | 5/1992 | Japan | 123/188.3 |

*Primary Examiner*—Henry C. Yuen
*Assistant Examiner*—Erick Solis
*Attorney, Agent, or Firm*—James J. Ralabate

[57] ABSTRACT

This invention relates to a novel valve useful in internal combustion engines and other engines having improved wear and corrosion properties. The valve has a uniform coating thereon containing nickel and having a thickness not exceeding 0.000500 inches. The coating must be substantially uniform in thickness throughout its extension.

20 Claims, 1 Drawing Sheet

ENGINE VALVE

This invention relates to valves useful in internal combustion engines and, more specifically, to a valve coating containing nickel.

BACKGROUND OF THE INVENTION

The manufacture of valves for internal combustion engines has had to keep pace with the drastic changes in auto engines. For example, with the introduction of low lead gasoline and the use of high compression engines, valves previously acceptable were no longer suitable. It was required to drastically modify valve manufacturing procedures to provide acceptable valves having improved wear properties while workable within the small tolerances allowed in combustion chambers. Various valve coatings have been used such as nickel, chrome, nitride and other known coating materials. A problem encountered in these processes is to obtain a thick enough coating to minimize corrosion and yet function within tolerances required in these advanced engines. Uniformity of coating and a smooth valve coating surface are properties that enhance the adaptability of these valves. The requirements of today's engines has caused increased problems for everyone involved in engine manufacture. The increase in running temperatures, lightweight blocks and heads and no-lead fuels have placed a high demand on manufacturers to develop superior designs and materials to operate under tougher conditions and more economically than they did in the past. In addition to these demands, when it comes time to rebuild the engine, it is necessary to stick to the proper specifications and proper material for each application of the engine.

The area of concern that is becoming a big issue is proper valve life. Valve open and close 25 times a second when the engine is operating at 3,000 RPM. That is a tremendous amount of movement when you consider the valve receives the least amount of lubrication of all the other internal moving parts of the engine. This means that the valve, seat, guide and geometry must all be correct and working properly for the valve to survive. The four main causes of premature valve failure are geometry, clearance, material and heat. The geometry of the valve and rocker is a difficult measurement to calculate, however, it is important. When the geometry is incorrect, it causes uneven wear of the valve stem and guide which results in engine failure. As the guide wears, the clearances increase which will cause excess oil consumption. More serious and costly damage is caused when improper geometry causes the valve to close off center of the seat resulting in valve stem fatigue at the head and keeper groove areas of the valve. This leads to the valve breaking.

Various suggestions have been made to provide adequate valves for today's engine use. In U.S. Pat. No. 5,190,002 (Wietig) a valve having cross-hatching was disclosed, said cross-hatching having a depth sufficient to maintain lubrication while at the same time smooth enough to provide minimal wear on contacting parts. In U.S. Pat. No. 4,811,701 (Buhl) coated valves are disclosed using cerium oxide coatings ad a process for effectuating this coating is given. In U.S. Pat. No. 2,664,873 (Graham) a coated valve is disclose having coatings in the thickness range of between 0.001 to 0.015 inch. Graham suggests that alloys containing aluminum and nickel either alone or together with other constituents be used. The use of these metals as coatings within 0.001 to 0.015 inch, Graham suggests, would provide valve bondings to the base metal. A method for coating the valve is disclosed by Graham to include etching the valve with sulfuric acid and depositing the nickel electrolytically. While Graham's 1954 coated valves were adequate for resisting corrosion and proper engine clearances, these valves would not function in today's advanced engines. The engine requirements in 1954 were far less demanding tan are the requirements of today's high compression engines. Also, electrolytic nickel coating of valves would not be acceptable today primarily because of the non-uniformity of the valve coatings.

A coated valve is required that gives a proper balance between a thickness as that will prevent corrosion and wear and yet will not interfere with valve stem to guide clearance.

Electroless Nickel can protect the base valve from serious corrosive attack. The 1990 Clean Air Act requires the automotive industry to reduce emissions and one possibility can be to utilize methanol fuel blends. However, a major drawback is the extreme corrosive nature these fuels have on currently designed vehicles. Electroless Nickel on steel demonstrated the best corrosion performance under controlled test conditions of CM85A and CM85AP fuels better than stainless steel 304 because it is a barrier coating and can be applied to the entire valve without disturbing its tolerance.

SUMMARY OF THE INVENTION

It is therefore an object of this invention to provide an internal combustion engine valve devoid of the above disadvantages and Paving improved properties for use in today's advanced engines.

Another object of this invention is to provide a valve having improved wearability and proper valve stem to valve guide clearances.

A further object of this invention is to provide a novel valve and valve process that will result in a valve having a substantially uniform protective coating.

A still further object of this invention is to provide a valve compatible with today's engines that balances proper protection thicknesses with proper valve clearances.

Another still further object of this invention is to provide a novel valve that is comparatively economical to manufacture.

The foregoing objects and others are accomplished in accordance with this invention by providing a novel valve having a substantially uniform nickel-containing coating having a thickness of from about 0.000030 to 0.000500 inches.

Valves used today are generally made from a ferrous material usually coated with chrome or other suitable coatings. The present invention utilizes conventional ferrous valves coated with a substantially uniform nickel-containing material substantially free of electroplated chromium nodules that can cause uneven wear. These valves can be used in vehicles of any type including portable powered equipment, motor vehicles, locomotive engines and the like. The thickness of the coating is thin enough to fit within the tolerances of today's engines while, at the same time, providing maximum protection against wear and oxidation. To exceed the present upper coating thickness range of 0.000500 inches would not improve protective properties and would cause severe tolerance problems in today's engines.

Some of these problems would be disproportioning of lubricant throughout the valve stem which would cause the valve to stick or gaul and would result in undesirable air emissions which would adversely affect engine performance. The use of electrolytic coating processes such as suggested by Graham above noted, would not result in an adequate valve for present engines. Also, the coating uniformity (plus or minus 10%) required could not be realized by generally known electrolytic coating techniques. This 10% uniformity s referred to throughout this disclosure and claims "substantially uniform". It has been found that to obtain a coating that is uniform and can be easily controlled within the presently defined coating range thickness, using a Electroless Nickel process would be highly preferred. Thus, there is a pressing need for valve stem coatings reduce the frictional coefficient and provide a hard r-resistant surface; the present invention provides this.

Electroless Nickel is a chemical reduction of nickel ions to metallic nickel by the introduction of an activated metallic surface. The reaction will deposit an equal amount of coating wherever the solution is in contact and will continue as long as solution chemistries are maintained within a prescribed specification, either manually or automatically.

Electroless Nickel solutions are typically formulated as follows:

Deposition mechanism

The overall reaction in the hypophosphite reduction of nickel ions may be broadly written as:

$$3NaH_2PO_2+3H_2O+NiSO_4 \rightarrow 3NaH_2PO_3+H_2SO_4+2H_2$$

the same reaction has been formulated as:

$$2H_2PO_2+Ni+++2H_2O \rightarrow 2H_2PO_3+H_2+2H+ +Ni^{\circ}$$

or alternatively as:

$$Ni+++H_2PO_2+H_2O \rightarrow Ni^{\circ}+H_2PO_3+2H+$$

All these reactions take place in electroless nickel processes on catalytically active surfaces with input of external energy, i.e., a higher temperatures (60° C.–95° C.). In addition to metallic nickel, Ni+ some molecular hydrogen is also formed. Apart from this, formation of H+ ions results in the baths becoming more acidic while orthophosphite ions $H_2PO_3$ are also formed.

HOW ELECTROLESS Nickel IS APPLIED

The following are necessary:

(1) A source of nickel
(2) A reducing agent
(3) Heat
(4) Complexing agents
(5) Buffing agents
(6) Accelerators
(7) Stabilizers Electroless Nickel PRETREATMENT for VALVES MADE FROM FERROUS-BASED ALLOYS The following are done to retreat the valve:

(1) Degrease
(2) Soak clean
(3) Rinse
(4) Periodic reverse electro clean
(5) Rinse
(6) Acid activate
(7) Rinse Then plate by Electroless Nickel process to specification and rinse in an appropriate solution.

Processes

The optimum or preferred embodiment of this invention is an Electroless Nickel coating containing a Phosphorus of 2–4% that has a hardness above Rockwell C-55 (Microhardness Converted) from Vickers which is a known standard. The American Society for Testing and Materials provides in its annual Book of A.S.T.M. Sandards standard test methods for microhardness of materials including Vickers test procedures; see designation E384-84 for example. Other ranges of phosphorus may be used providing the hardness and wear resistance can be achieved either through age hardening or bath formation. Other commercial available coating formulations which are useful in the present invention and which follow the tribological properties of Electroless Nickel/Phosphorus coating are:

A. Electroless Nickel-Boron
B. Composite Nickel Coating such as:
   Teflon
   Silicon-Carbide
   Diamond
C. Alloy coating such as
   Nickel-Cobalt
   Nickel-Tungsten-Boron Uniqueness of micro hardness of electroplated sulfamate nickel as compared to Electroless Nickel:

| Electroplated Nickel | Electroless Nickel (Process used in present invention) |
|---|---|
| Range: 150 HVN–400 HVN | 600 HVN–850 HVN |

As can be seen, the Electroless Nickel has over double the micro hardness of the electroplated sulfamate nickel. This higher hardness directly translates to better wear resistance as can be seen on Taber Wear Data; see page 130 of Electroless Nickel Plating by W. Riedel, 1991 Edition by ASM International published by Finishing Publications Ltd. The Taber Wear Index is n industry accepted standard for abrasion wear which screens one coating from another with the desire to have the lowest possible values respectively. Taber Wear Index Panels are plated with the desired coating and abraded with CS-10 bonded wheels under a 1000 gram load for 5000 cycles. The pane were weighed to nearest 0.01 mg before and after each increment so that their weight loss and Taber Wear Index could be determined.

The clearance between valve stem and valve guide is designed in order to guarantee sealing against combustion gases as well as to hold capillary oil film for sufficient sliding characteristics. The design engineer attaches great importance to the choice of appropriate materials for valve stem and valve guide.

The coefficient of expansion and the thermal conductivity of both materials are of special importance. If the valve guide is too narrow, the stem wear can be so intensive that the valve function is disturbed. If the clearance between valve stem and valve guide is too ample, an excessive oil varnish formation respectively oil carbon formation happens in most of the cases. The lubricating oil overflows at that side of the valve guide being exposed to the combustion chamber and forms a layer of oil varnish on the stem surface or is allowed to pass into the combustion chamber and create a source of emission. Eventually, by the oil carbon burning up, a correct sliding of the stem in its guide is impossible and consequently it will stick.

Specifics on Electroless Nickel plating are further defined in U.S. Pat. No. 4,746,375 and in the publication Electroless Nickel Plating, Volume 1 No. 2 by Metal Finishing Suppliers Association, 1025 E. Maple Road, Birmingham, Mich. 48011, both of which are incorporated into this disclosure by reference. Several of the nickel containing alloys useful in the process of the present invention are disclosed in this publication. Some of these are nickel alloyed with boron, phosphorus, cobalt, iron, tungsten, rhenium, molybdenum boron and any mixtures thereof.

The following examples will further define preferred embodiments and the specifics of the present invention.

Example I

A valve made from a ferrous based alloy identified as Manley Valve—Part S2140 and obtained from Safeguard Engine Parts, a division f KSG Industries Inc. of 151 South Warner Road, Suite 205, Wyne, Pa. 19087 was degreased with a commercially available citric solvent containing no CFC's and soaked clean. The cleaned valve was rinsed with ordinary tap water and periodically reverse electro-cleaned by equal time of two minutes each with an amperage of 15 amperes per square foot, both anodically and cathodically, rinsed and acid activated. The valve was then rinsed with ordinary tap water and put into an Electroless Nickel tank manufactured by Elnic Inc. The alloy used to nickel coat the valve was 2–4% phosphorus by weight.

Example II

The Electroless Nickel solution was controlled to manufacture specification by using an automatic chemical controller/analyzer supplied by Enthone OMI Model 2200. Both the nickel concentrates and pH were controlled within 95% of manufacturer's optimum value.

Example III

The Electroless Nickel was supplied by Enthone OMI and is designed as Enplate ® Ni-7322 Low Phosphorous, Low Temperature, High Speed Electroless Nickel Process. The optimum nickel concentration is 0.77 oz/gal. and pH 6.2, phosphorus 2–4% by weight.

Example IV

The valve that was plated was a commercially produced intake valve of low alloy that was racked and agitated.

Example V

The temperature of the Electroless Nickel solution was controlled to 82° C. plus or minus four degrees by electric immersion heaters with a Glow Quartz D-100 controller.

DETAILED DESCRIPTION OF THE DRAWINGS AND PREFERRED EMBODIMENTS

Figure 1:
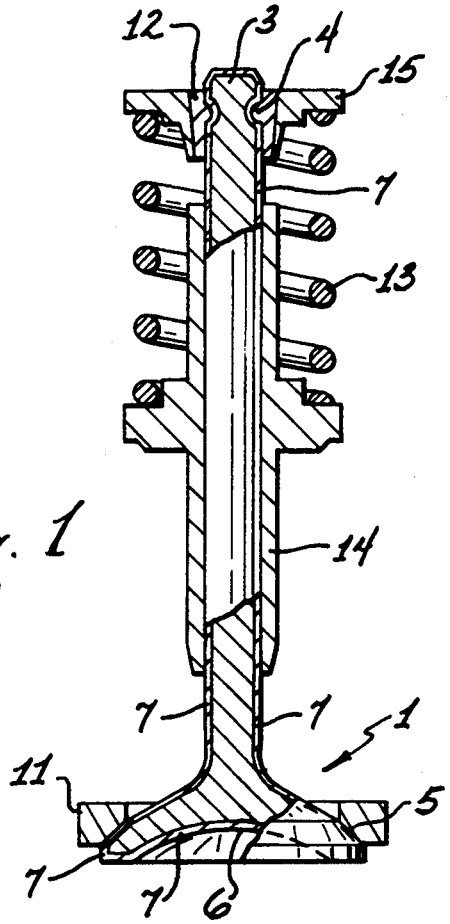
FIG. 1 is a plan view of the valve of this invention with a nickel containing coating on the entire outer surface of the valve.

In FIG. 1 an engine valve 1 is illustrated having a conventional configuration, i.e. a stem 2, a tip 3, a lock groove 4, a face 5, a bottom cup 6, lock 12 and lock cap 15. The entire outer surface of valve 1 is coated in FIG. 1 with a nickel containing composition 7 having a critical thickness of from 0.00000 to 0.000500 inches. For best results a thickness of up to 0.000150 inches is preferred because optimum minimum wear is achieved at this thickness. In the publication *Chilton's Auto Repair Manual,* 1989–1993, published by Chilton Book Company, Capital Cities-ABC, Inc., Chilton Way, Randnor Pa. 19089, valve stem-to-guide clearances for 1993 automobiles are published. The valve coating 7 thickness of the present invention is compatible with all of the engines listed in Chilton's.

The average stem-to-guide clearance allows for free motion of the valve stem within the valve guide. The stem-to-guide clearance is a published tolerance for engine assembly of intake and exhaust valves. It can be easily calculated by subtracting the valve stem diameter from the valve guide diameter. In order to have free motion of the valve stem within the valve guide, the calculated stem-to-guide clearance must be within the published tolerance.

From Chilton's Auto Repair Manual for 1993 Engines, the average intake stem-to-guide clearance is 0.002100 inches, whereas the average exhaust stem-to-guide clearance is 0.002700 inches exhaust clearance is larger to accommodate thermal expansion of the valve during engine operation.

The use of the no Led applications thickness would still allow free motion of the valves within the guides. However, the use of prior art minimum thickness would not allow free motion of the valve stem within the valve guide because the calculated valve-to-stem clearance would be outside the published tolerance.

Terms As Used Throughout

Valve Stem-to-guide Clearance: is a published tolerance. It is calculated by subtracting the valve stem diameter from the valve guide diameter.

Thickness: is a dimension of coating depth applied to a component.

Figure 2:
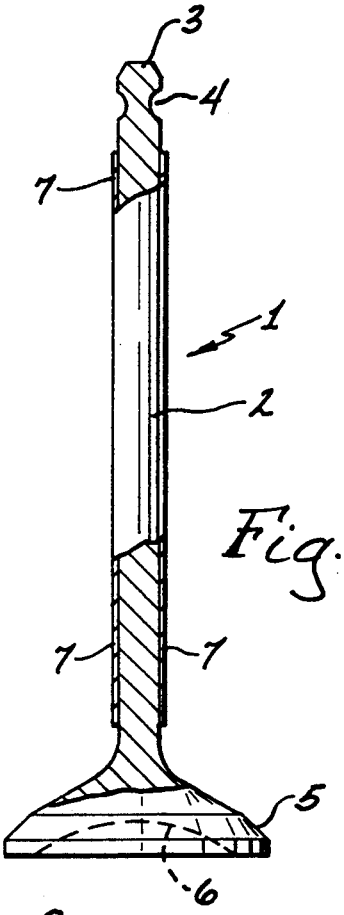
FIG. 2 is a plan view of the valve of this invention with just the s em portion of the valve coated.

A thin enough coating 7 is desirable but within the thickness limits (plus or minus 10%) of the present invention and comprised of only nickel-containing compositions. Coatings that are too thick would cause leaking on the valve seat blow-bys which are gases which escape because of not seat properly and uneven wear which would eventually cause engine performance breakdown. It is also important that each valve be coated uniformly within the thickness limits of this invention and uniformly throughout the coating. It is critical to this invention that only nickel-containing compositions be used since chrome, which is commonly used, cannot be properly coated at these thicknesses without the formation of nodules which would seriously impede the performance of the valve. Also, nickel is capable of uniform coating and does not impede the assembly to the locking groove of commercially available valves. In addition, the valve face will not seal properly to the valve seat. Thus, using coating materials other than nickel containing compositions, exceeding the coating thicknesses or forming a on-uniform coating would result in commercially unacceptable valves for present car engines. Exceeding a coating thickness of 0.000500 inches would cause misalignment, disproportioning of lubricant throughout stem 1 and would cause the stem 1 to stick causing air emissions and poor performance results. Using a coating below our 0.000030 inch range would result in a coating that would not give the proper corrosion and wear resistance to the stem 1. In FIG. 1 valve 1 it entirely coated with a nickel composition. Valve seat 11 mates with face 5 while valve guide 14 guides the vertical movement of the valve 1. Cap 15 and cap lock 12 both lock valve spring 13 in position and provides the upper lock for valve tip 3. While FIG. 1 illustrates a stem 1 completely coated with nickel-containing coating , there are situations (FIG. 2) when it is desirable to partial coat such as just the stem 2 of valve 1 as shown in FIG. 2. Some situations where a partial coating of nickel composition is desirable are when a ceramic insulator is applied for heat properties. A nickel plating of that area would interfere with that application. Another situation where partial coating of the stem is desirable is in locomotive engines that have a special requirement of both high corrosion resistance to fuel contaminants such as residual fuels (high sulfur bearing) and wear demands where greater thicknesses in specific areas are desired. Electroless Nickel plating with greater thickness in the lock or seat areas can interfere with mating components. The coating should have a thickness uniformity not exceeding 10% or within 10% of nominal or a norm.

Figure 3:
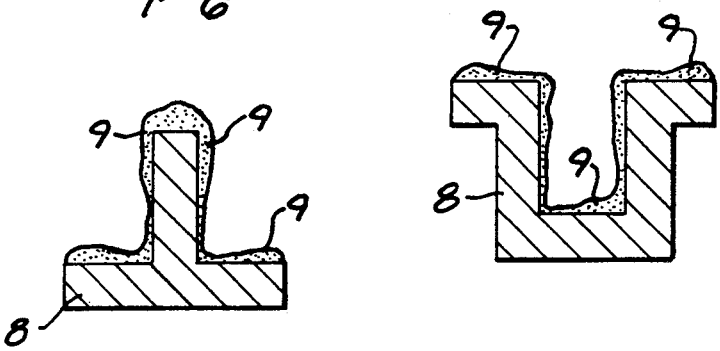
Fig. 3 PRIOR ART
FIG. 3 is a schematic of an object coated with an electroplating process of prior art.
Figure 4:
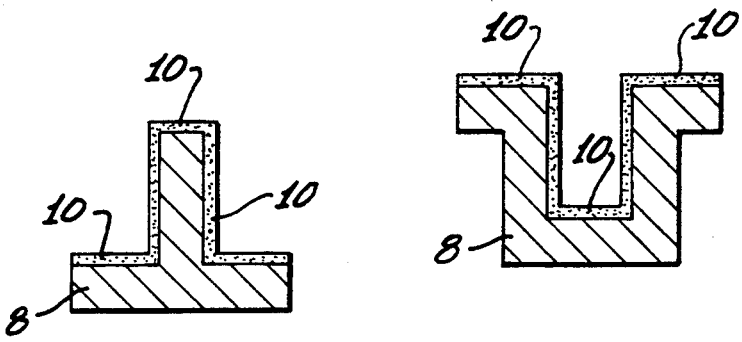
FIG. 4 is a schematic of an object uniformly coated using an Electroless Nickel coating process as used in the present invention. This figure shows the unique uniformity of a nickel coating that is possible using an Electroless Nickel process.

In FIG. 3 an object 8 is shown, as in the prior art, with a metallic coating 9 deposited by an electroplating process. The thickness distribution of coating 9 is uneven and would cause serious problems if used to coat an entire engine valve of FIGS. 1 or 2. In FIG. 4 these same objects 8 coated by use of an Electroless Nickel process resulting in coatings 10 that are perfectly uniform and ideal for uniformly coating a valve of FIGS. 1 or 2. Verification of this distinction can be made by reference to Electroless Nickel Plating by W. Riedel-1991 Edition by ASM International published by Finishing Publications Ltd., page 82.

The preferred and optimumly preferred embodiments of the present invention have been described herein and shown in the accompanying drawings to illustrate the underlying principles of the invention but it is to be understood that numerous modifications and ramifications may be made without departing from the spirit and scope of this invention. For example, the coating of this invention, in addition to containing nickel and other metals, may also contain Teflon (a trademark of Du Pont De Nemours E.I.& Co.) or other suitable solid lubricants for additional lubricating properties.

What is claimed is:

1. A valve for use in internal combustion engines comprising a valve and a coating over at least a portion of said valve, said coating being substantially uniform and comprised of a nickel-containing composition, said coating thickness of from about 0.000030 inches to about 0.000500 inches.

2. The valve of claim 1 wherein said coating thickness has a uniformity within about plus or minus 10%.

3. The valve of claim 1 wherein said coating comprises nickel with a material selected from the group consisting of boron, phosphorus, cobalt, iron, tungsten, rhenium, molybdenum and mixtures thereof.

4. The valve of claim 1 wherein said coating is a substantially uniform coating comprising nickel and a material selected from the group consisting of boron, phosphorus, cobalt, iron, tungsten, rhenium, molybdenum and mixtures thereof, said coating having a thickness not exceeding about 0.000500 inches.

5. The valve of claim 1 wherein said coating is positioned over substantially the entire outer surface of said valve.

6. The valve of claim 1 wherein said coating is positioned solely over a stem portion of said valve.

7. The valve of claim 1 wherein said coating comprises an alloy of nickel and phosphorus.

8. The valve of claim 1 wherein said coating contains Teflon.

9. A valve for use in internal combustion engines comprising a ferrous valve having a protective coating on at least a portion thereof, said coating physically attached to at least a portion of an outer surface of said valve and having a thickness of from about 0.000030 to about 0.0001500, said coating comprising a composition containing nickel and having a substantially uniform thickness throughout its plating.

10. The valve of claim 9 wherein said coating thickness has a uniformity about plus or minus 10%.

11. The valve of claim 9 wherein said coating comprises nickel with a material selected from the group consisting of boron, phosphorus, cobalt, iron, tungsten, rhenium, molybdenum and mixtures thereof.

12. The valve of claim 9 wherein said coating is a substantially uniform coating comprising nickel and a material selected from the group consisting of boron, phosphorus, cobalt, iron tungsten, rhenium, molybdenum and mixtures thereof, said coating having a thickness not exceeding about 0.0001500 inches.

13. The valve of claim 9 wherein said coating is positioned over substantially the entire outer surface of said valve.

14. The valve of claim 9 wherein said coating is positioned solely over a stem portion of said valve.

15. The valve of claim 9 wherein said coating comprises an alloy of nickel and phosphorus.

16. The valve of claim 9 wherein said coating contains Teflon or other solid lubricants.

17. A process for the production of a valve useful in internal combustion engines, said process comprising a pretreat-cleaning of the surface of said valve, acid dipping said valve, rinsing said valve and subsequently in a depositing step depositing a nickel-containing coating over at least a portion said valve, said coating step controlled so as to deposit a coating on said valve having a thickness of from about 0.000030 inches to about 0.000500 inches.

18. The process of claim 17 wherein said depositing step comprises the use of an Electroless Nickel plating process.

19. The process of claim 17 wherein said valve is immersed in a nickel-containing bath during said depositing step, said depositing step comprises an Electroless Nickel plating process.

20. The process of claim 17 wherein Teflon is a composite which is combined with the coating in a plating process or post plating process step.

* * * * *